US011613954B2

(12) United States Patent
Dalziel et al.

(10) Patent No.: US 11,613,954 B2
(45) Date of Patent: Mar. 28, 2023

(54) SUBSEA SAFETY NODE

(71) Applicant: Baker Hughes Energy Technology UK Ltd, Bristol (GB)

(72) Inventors: Robert Dalziel, Bristol (GB); Ian Kent, North Somerset (GB)

(73) Assignee: BAKER HUGHES ENERGY TECHNOLOGY UK LIMITED, Bristol (GB)

( * ) Notice: Subject to any disclaimer, the term of this patent is extended or adjusted under 35 U.S.C. 154(b) by 0 days.

(21) Appl. No.: 15/750,968

(22) PCT Filed: Jul. 29, 2016

(86) PCT No.: PCT/EP2016/068145
§ 371 (c)(1),
(2) Date: Feb. 7, 2018

(87) PCT Pub. No.: WO2017/025351
PCT Pub. Date: Feb. 16, 2017

(65) Prior Publication Data

US 2018/0230768 A1 Aug. 16, 2018

(30) Foreign Application Priority Data

Aug. 10, 2015 (GB) ..... 1514080

(51) Int. Cl.
*E21B 34/04* (2006.01)
*E21B 43/01* (2006.01)
(Continued)

(52) U.S. Cl.
CPC ..... *E21B 33/0355* (2013.01); *E21B 34/04* (2013.01); *E21B 43/01* (2013.01); *F15B 13/0807* (2013.01); *F15B 20/00* (2013.01)

(58) Field of Classification Search
None
See application file for complete search history.

(56) References Cited

U.S. PATENT DOCUMENTS 5,335,730 A 8/1994 Cotham, III
8,511,389 B2 * 8/2013 Fenton ..... E21B 33/0385 166/368
(Continued)

FOREIGN PATENT DOCUMENTS

EP 2 383 426 A2 11/2011
EP 2 674 568 A1 12/2013
(Continued)

OTHER PUBLICATIONS

Childers, M.A., et al., "Fast Response Retrofitable Ultra Deepwater BOP Control System," Society of Petroleum Engineers, pp. 1-17, (Mar. 2004).
Invitation to pay additional fees issued in connection with corresponding PCT Application No. PCT/EP2016/068145 dated Oct. 14, 2016.
(Continued)

*Primary Examiner* — Matthew R Buck
*Assistant Examiner* — Douglas S Wood
(74) *Attorney, Agent, or Firm* — Hogan Lovells US LLP

(57) ABSTRACT

A safety node for a hydrocarbon extraction facility control system, the node comprising: a hydraulic input; a hydraulic output; a directional control valve disposed between the hydraulic input and the hydraulic output; and a functional safety electronics module containing a logic solver in operable communication with the directional control valve; wherein the logic solver is configured to operate the directional control valve to permit hydraulic communication between the hydraulic input and the hydraulic output in response to the presence of a given condition and inhibit hydraulic communication between the hydraulic input and the hydraulic output in response to the absence of a given condition.

13 Claims, 5 Drawing Sheets

(51) Int. Cl.

| | |
|---|---|
| ***E21B 33/035*** | (2006.01) |
| ***F15B 13/08*** | (2006.01) |
| ***F15B 20/00*** | (2006.01) |

(56) References Cited

U.S. PATENT DOCUMENTS

| | | | | |
|---|---|---|---|---|
| 2004/0216884 | A1* | 11/2004 | Bodine | E21B 33/0355 166/335 |
| 2011/0266003 | A1* | 11/2011 | Singh | E21B 33/064 166/368 |
| 2012/0273211 | A1* | 11/2012 | Choudhury | E21B 33/064 166/336 |
| 2015/0096758 | A1* | 4/2015 | Babbitt | E21B 33/064 166/335 |
| 2015/0275608 | A1* | 10/2015 | Breda | E21B 33/0385 166/368 |
| 2017/0356264 | A1* | 12/2017 | Corneliussen | E21B 33/0355 |

FOREIGN PATENT DOCUMENTS

| | | | |
|---|---|---|---|
| EP | 2 738 348 | A1 | 6/2014 |
| GB | 2 338 971 | A | 1/2000 |
| GB | 2 421 524 | A | 6/2006 |
| WO | 2006/068873 | A1 | 6/2006 |
| WO | 2008/070630 | A2 | 6/2008 |

OTHER PUBLICATIONS

Search Report issued in connection with corresponding GB Application No. GB1514080.9 dated Mar. 10, 2016.

International Search Report and Written Opinion issued in connection with corresponding PCT Application No. PCT/EP2016/068145 dated Jan. 23, 2017.

International Preliminary Report on Patentability issued in connection with corresponding PCT Application No. PCT/EP2016/068145 dated Feb. 13, 2018.

* cited by examiner

SUBSEA SAFETY NODE

FIELD OF THE INVENTION

The present invention relates to a safety node which can be retrofitted into a control system for an underwater (e.g. subsea) hydrocarbon well facility.

BACKGROUND TO THE INVENTION

It is often desirable to protect components of underwater hydrocarbon extraction facilities against conditions that were not foreseen when the facility was initially installed. An example of this may be a subsea tree that experiences extremely low temperatures due to the effects of Joule-Thompson cooling due to gas lifting being used late in the life of the field at which the tree is deployed.

Replacing entire facilities, or components of facilities, can be extremely costly and impractical. It is therefore desirable to protect existing facilities. It is an aim of the present invention to provide such protection. This is achieved by retrofitting existing facilities with a safety node that can protect the components of the facility from unforeseen conditions by preventing them from being operated outside of their design parameters (e.g. outside an operating temperature range), without altering the entire control system of the facility.

SUMMARY OF THE INVENTION

In accordance with one aspect of the invention there is provided a safety node for a hydrocarbon extraction facility control system, the node comprising: a hydraulic input; a hydraulic output; a directional control valve disposed between the hydraulic input and the hydraulic output; and a functional safety electronics module containing a logic solver in operable communication with the directional control valve; wherein the logic solver is configured to operate the directional control valve to permit hydraulic communication between the hydraulic input and the hydraulic output in response to the presence of a given condition and inhibit hydraulic communication between the hydraulic input and the hydraulic output in response to the absence of a given condition.

The safety node could further comprise a vent line connected to the directional control valve, and the logic solver could be configured to operate the directional control valve to permit hydraulic communication between the hydraulic input and the vent line in response to the absence of the given condition.

The given condition could be a range of temperatures, pressures or other process condition (e.g. sand detection).

The safety node could further comprise a wet mate connector in communication with the functional safety electronics module to allow an external power supply be connected to the safety node.

The safety node could further comprise a wet mate connector in communication with the functional safety electronics module to allow an external sensor to be connected to the safety node. The safety node could further comprise a wet mate connector in communication with the functional safety electronics module to allow sensor readings to be output from the safety node.

In accordance with another aspect of the invention there is provided a hydrocarbon extraction facility comprising a control system, said control system including a safety node as described above. The safety node could be located at a stab plate of the hydrocarbon extraction facility In accordance with an additional aspect of the invention there is provided a method of controlling a valve in a hydrocarbon extraction facility comprising the steps of: providing a control system for the hydrocarbon extraction facility, the control system comprising a subsea control module having a hydraulic line; providing a safety node, said safety node comprising a hydraulic input, a hydraulic output, a directional control valve disposed between the hydraulic input and the hydraulic output, and a functional safety electronics module containing a logic solver in operable communication with the directional control valve, the hydraulic line being connected to the hydraulic input and the hydraulic output being connected to the valve; operating the directional control valve to permit hydraulic communication between the hydraulic input and the hydraulic output in response to the presence of a given condition and inhibit hydraulic communication between the hydraulic input and the hydraulic output in response to the absence of a given condition; and supplying hydraulic pressure to the hydraulic line when the directional control valve is operated to permit hydraulic communication between the hydraulic input and the hydraulic output to operate the valve in the hydrocarbon extraction facility.

In accordance with an aspect of the invention there is provided a method of retrofitting a control system for an underwater hydrocarbon extraction facility with a safety node, the control system comprising a subsea control module operably connected to a valve in an underwater hydrocarbon extraction facility through a hydraulic line, the safety node comprising:

a hydraulic input; a hydraulic output; a directional control valve disposed between the hydraulic input and the hydraulic output; and a functional safety electronics module containing a logic solver in operable communication with the directional control valve; wherein the logic solver is configured to operate the directional control valve to permit hydraulic communication between the hydraulic input and the hydraulic output in response to the presence of a given condition and inhibit hydraulic communication between the hydraulic input and the hydraulic output in response to the absence of a given condition, the method comprising the steps of: disconnecting the hydraulic line from the valve; connecting the hydraulic line to the hydraulic input of the safety node; and connecting the hydraulic output to the valve.

The step of disconnecting the hydraulic line from the valve could be performed at a stab plate of the underwater hydrocarbon extraction facility.

The method could further comprise the step of: connecting an electrical power supply to the functional safety electronics module of the safety node.

The method could further comprise the step of: connecting an external sensor to the safety node, said external sensor monitoring the given condition.

The given condition could be a range of temperatures, pressures or other process condition (e.g. sand detection).

DETAILED DESCRIPTION OF THE INVENTION

Figure 1:
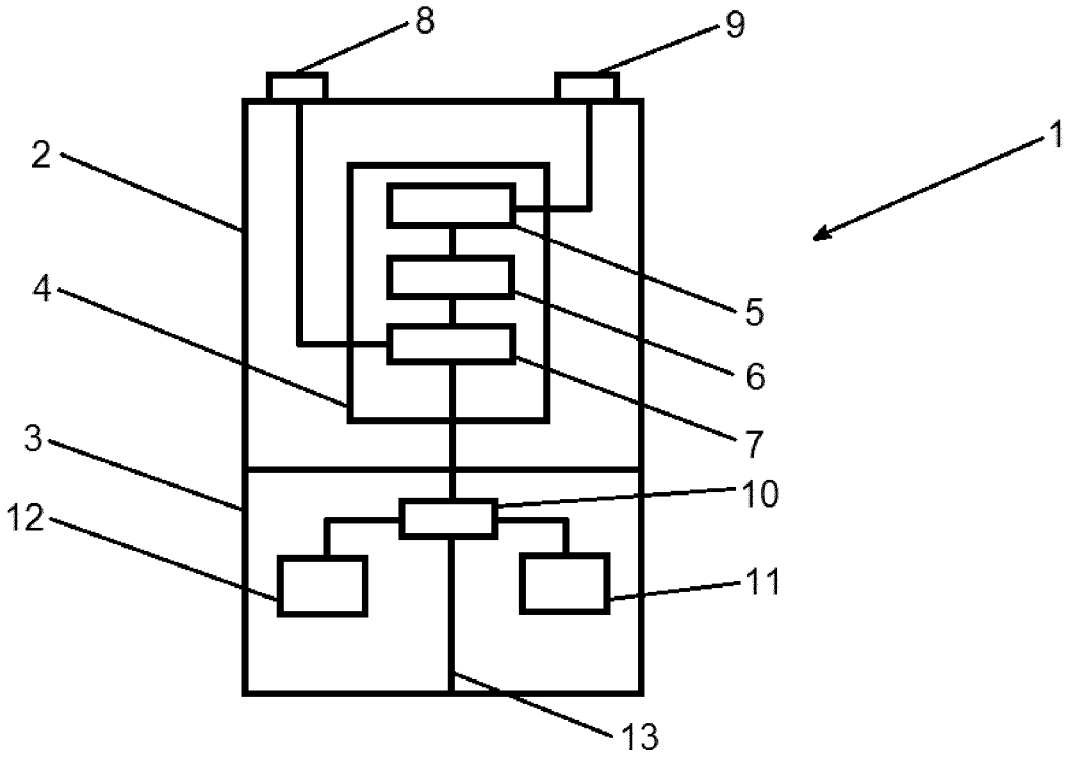
FIG. 1 is a schematic diagram of one embodiment of a safety node according to the present invention.

FIG. 1 schematically shows an embodiment of a safety node 1 according to the present invention. The safety node 1 comprises a housing 2 and a hydraulic manifold 3. The housing 2 is marinised to allow deployment of the safety node 1 to subsea locations.

The housing 2 contains a functional safety electronics module (FSEM) 4 which comprises a power supply unit 5 and a logic solver 6 with an input/output interface 7. A first wet mate electrical connector 8 allows a sensor to be connected to the interface 7. A second wet mate electrical connector 9 allows a power source to be connected to the power supply unit 5.

The hydraulic manifold 3 contains a directional control valve (DCV) 10, a hydraulic input 11 for receiving hydraulic fluid from a hydraulic circuit in use, a hydraulic output 12 for supplying hydraulic fluid to a hydraulic circuit in use, and a vent line 13. The DCV 10 is operable to allow hydraulic communication in a first path between the hydraulic input 11 and the hydraulic output 12, or to allow hydraulic communication in a second path between the hydraulic input 11 and the vent line 13. The interface 7 of the logic solver 6 is connected to the DCV 10 and may command the DCV 10 to switch between the above described hydraulic communication paths. In use, the vent line 13 vents into the sea.

Figure 2:
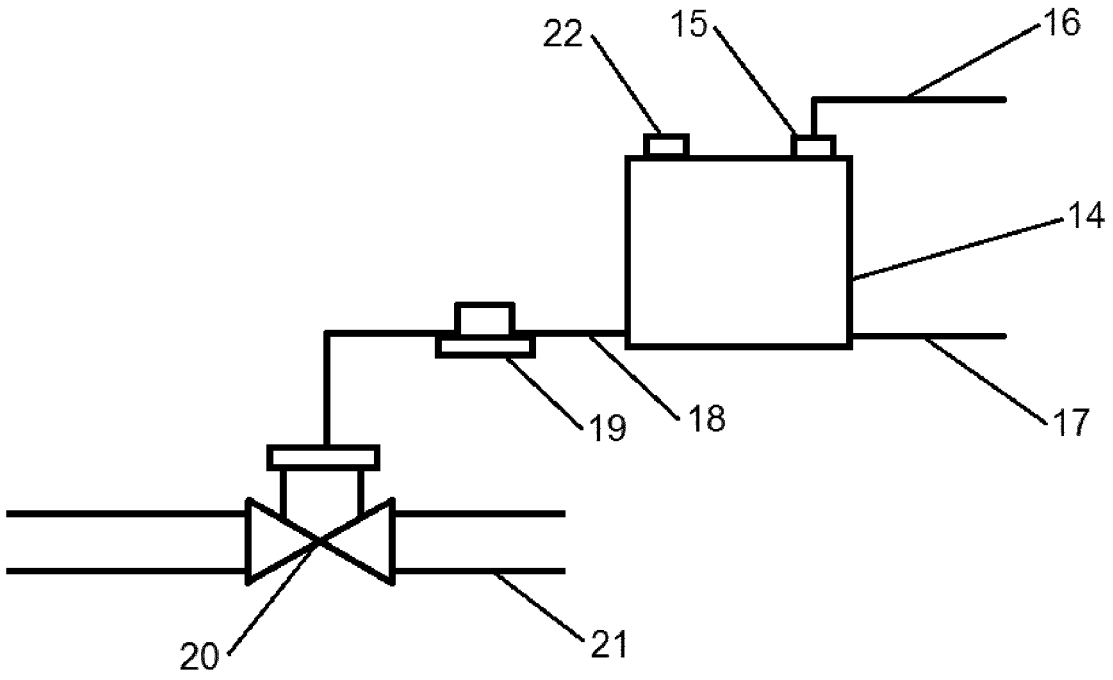
FIG. 2 is a schematic diagram of part of a control system for an underwater hydrocarbon well facility suitable for retrofitting with a safety node according to an embodiment of the present invention.

FIG. 2 schematically shows part of a control system for an underwater hydrocarbon well facility suitable for retrofitting with a safety node according to an embodiment of the present invention. The control system comprises a subsea control module (SCM) 14, which receives electrical power via a first wet mate connector 15 from an electrical supply line 16. The SCM 14 also receives a hydraulic supply from a hydraulic supply line 17. The SCM 14 contains various control means (not shown) for operating valves in a subsea well facility. In order to operate a valve 20, the SCM 14 supplies hydraulic power via a hydraulic output 18. In FIG. 2 the hydraulic output 18 passes a stab plate 19 on a Christmas tree at the wellhead and terminates at a production master valve 20 in pipework 21. The SCM 14 has a spare (i.e. unused) second wet mate connector 22.

Figure 3:
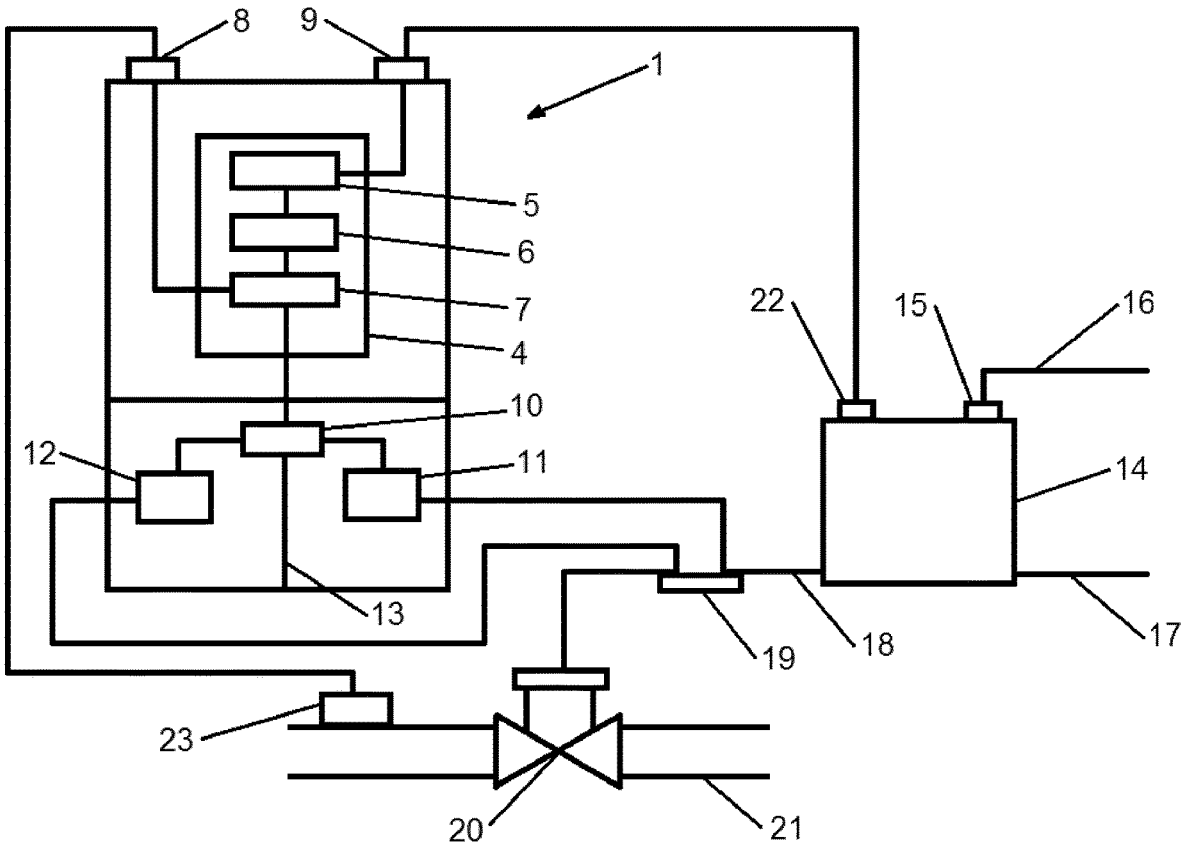
FIG. 3 is a schematic diagram of the safety node of FIG. 1 retrofitted into the control system of FIG. 2.

FIG. 3 schematically shows the safety node of FIG. 1 retrofitted into the control system of FIG. 2. Like reference numerals have been retained where appropriate.

In order to retrofit the control system with the safety node 1, the spare second wet mate connector 22 of the SCM 14 is connected to the second wet mate connector 9 of the safety node 1. This allows electrical power to be passed from the SCM 14 to the power supply unit 5 of the safety node 1. The hydraulic output 18 of the SCM 14 has been disconnected at the stab plate 19 and reconnected to the hydraulic input 11 of the safety node 1. The hydraulic output 12 of the safety node 1 has been connected back up to the stab plate 19 and terminates at the production master valve 20 in the pipework 21. A sensor 23 on the pipework 21 has been connected to the first wet mate connector 8 of the safety node 1 to put the sensor 23 in communication with the interface 7 of the logic solver 6 of the FSEM 4 of the safety node 1.

Figure 4:
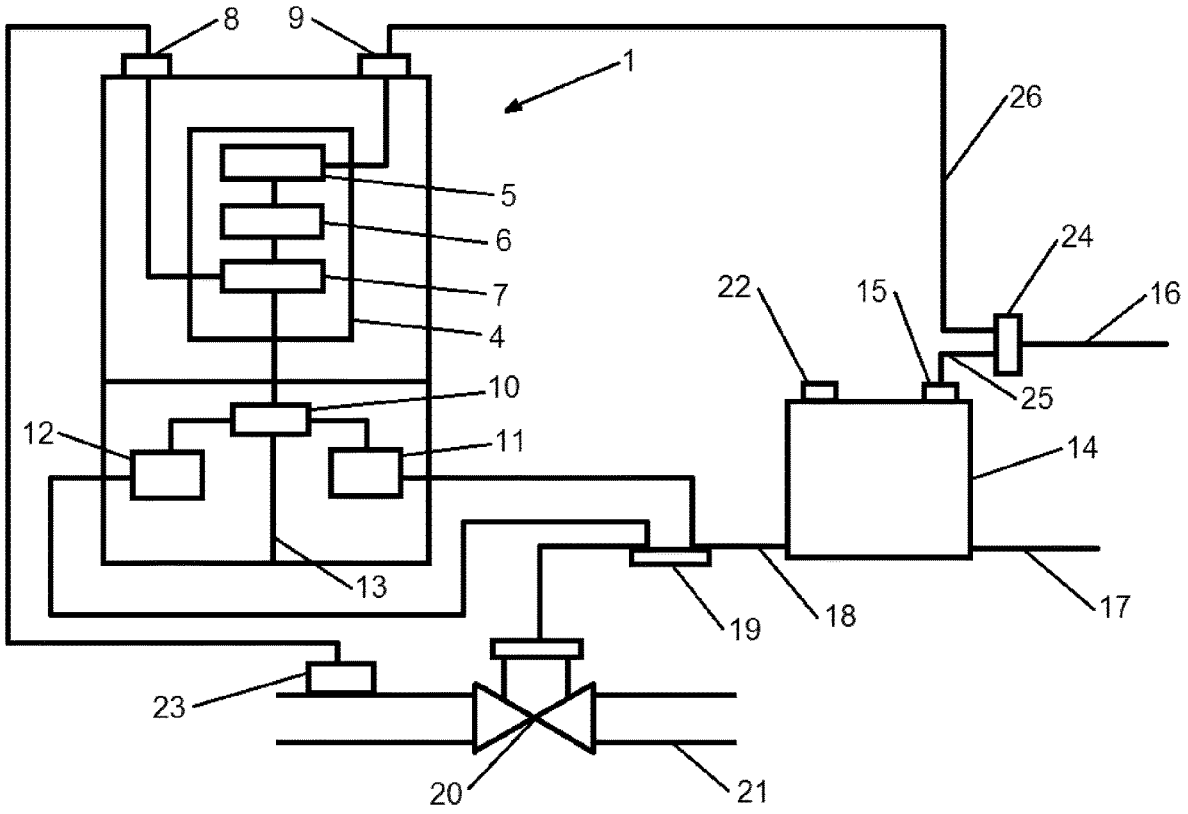
FIG. 4 is a schematic diagram of the safety node of FIG. 1 retrofitted into an alternative control system for an underwater hydrocarbon well facility.

FIG. 4 schematically shows the safety node of FIG. 1 retrofitted into a control system for an underwater hydrocarbon well facility in accordance with an alternative embodiment. The control system is similar to that shown in FIG. 2 and so like reference numerals have been retained where appropriate.

In the control system of FIG. 4, the SCM 14 does not have a power source suitable for powering the safety node 1. To overcome this problem, a wet mate connector 24 has been inserted into the electrical supply line 16 upstream of the SCM 14. The wet mate connector 24 splits the electrical supply line 16 into a pair of electrical supply lines 25 and 26. The first of these electrical supply lines 25 continues to supply electrical power to the SCM 14. The second electrical supply line 26 is connected to the second wet mate connector 9 of the safety node 1. The rest of the retrofit operation has been carried out identically to that shown in FIG. 3.

Figure 5:
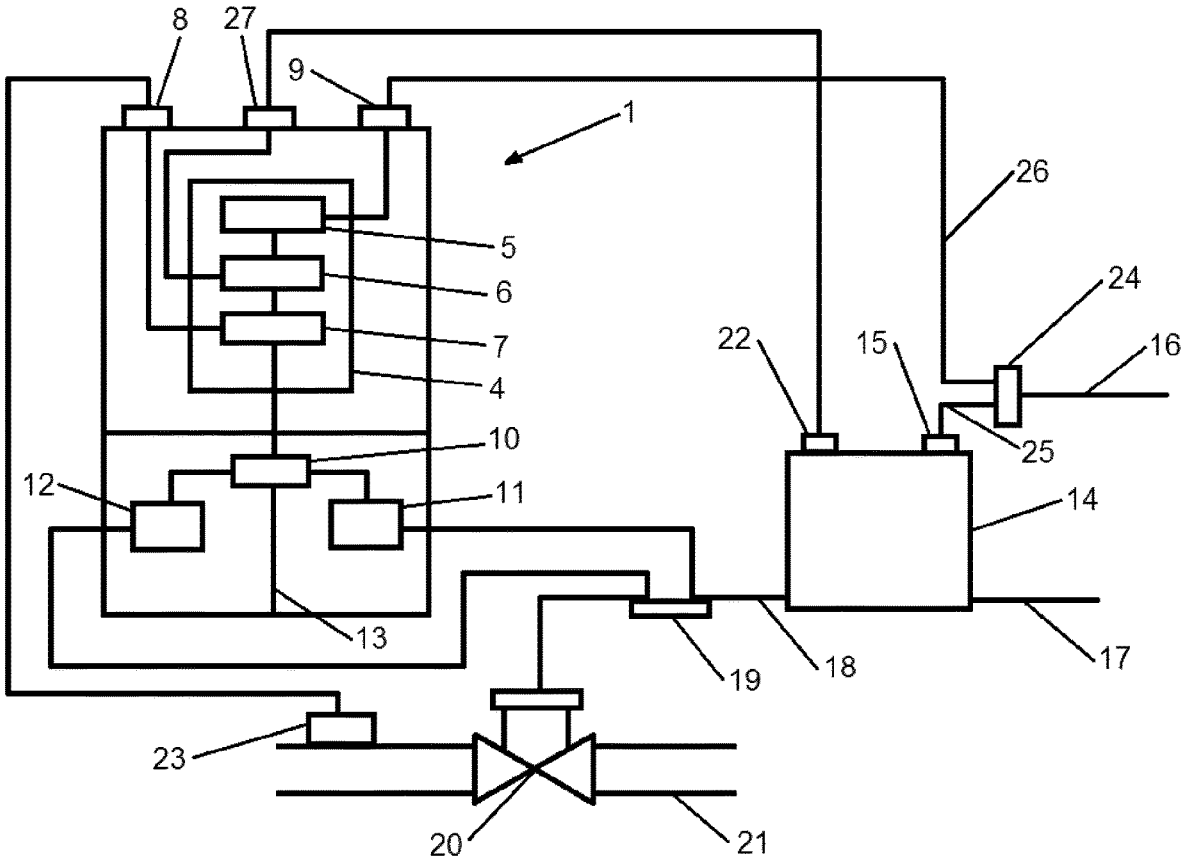
FIG. 5 is a schematic diagram of a further embodiment of a safety node according to an embodiment of the present invention retrofitted into a control system for an underwater hydrocarbon well facility.

FIG. 5 schematically shows a safety node according to an embodiment of the invention retrofitted into a control system for an underwater hydrocarbon well facility. The control system is similar to that shown in FIG. 4 and the safety node is similar to that shown in FIG. 1, and so like reference numerals have been retained where appropriate.

The safety node 1 of FIG. 5 has a third wet mate connector 27. In this control system the sensor 23 is an existing sensor (e.g. a pressure sensor) that was present in the control system prior to the retrofit operation, and was connected to wet mate connector 22 of the SCM 14. Here, the safety node 1 has been implemented in an 'in-line' configuration. The connection between the existing sensor 23 and the wet mate connector 22 of the SCM 14 has been disconnected reconnected between the sensor 23 and the first wet mate connector 8 of the safety node 1. A further connection has been made between the third wet mate connector 27 of the safety node 1 and the wet mate connector 22 of the SCM 14. This allows readings from the sensor 23 to be passed to the SCM 14 via the interface 7 of the logic solver 6 of the FSEM 4 of the safety node 1.

An advantage of the safety node is that subsea assets are protected from operating outside their design parameters, without the need to remove and replace components of the deployed control system.

Various alternatives and modifications within the scope of the invention will be apparent to those skilled in the art. For example, the safety node could be arranged to prevent hydraulic communication between the hydraulic input and hydraulic output in response to well pressure, temperature, production conditions such as, for example, sand detection, or the detection of subsea seismic activity.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What we claim is:

1. A hydrocarbon extraction system, comprising:
one or more sensors;
a hydraulically operated device;
a hydraulic supply line;
a subsea control module associated with a first housing comprising:
a subsea control module hydraulic input coupled to the hydraulic supply line;
a subsea control module hydraulic output; and
a control device for controlling flow between the hydraulic input the hydraulic output; and
a safety node associated with a separate second housing comprising:
a safety node hydraulic input coupled to the subsea control module hydraulic output;
a safety node hydraulic output coupled to the hydraulically operated device;
a directional control valve disposed between the safety node hydraulic input and the safety node hydraulic output;
a power supply;
a functional safety electronics module containing a logic solver in operable communication with the directional control valve, wherein the logic solver is configured to operate the directional control valve to permit hydraulic communication between the safety node hydraulic input and the safety node hydraulic output in response to the presence of a given condition and inhibit hydraulic communication between the safety node hydraulic input and the safety node hydraulic output in response to the absence of a given condition, the logic solver communicably coupled to the one or more sensors and receives data from the one or more sensors, and determines whether the given condition is present based at least in part on the data;
a first wet mate connector electrically coupled to the power supply to allow external power to be supplied to the power supply; and
a second wet mate connector electrically coupled to an interface for the logic solver and communicably coupling the logic solver to the one or more sensors;
wherein the subsea control module is arranged upstream of a stab plate associated with the safety node such that the hydraulic supply line passes through the subsea control module before terminating at a production master valve, and electric power is routed through the subsea control module to the safety node.

2. The hydrocarbon extraction system according to claim 1, further comprising a vent line connected to the directional control valve, wherein the logic solver is configured to operate the directional control valve to permit hydraulic communication between the safety node hydraulic input and the vent line in response to the absence of the given condition.

3. The hydrocarbon extraction system according to claim 1, wherein the given condition is a range of temperatures.

4. The hydrocarbon extraction system according to claim 1, wherein the given condition is a range of pressures.

5. The hydrocarbon extraction system according to claim 1, further comprising a third wet mate connector in communication with the functional safety electronics module to allow sensor readings to be output from the safety node.

6. The hydrocarbon extraction system according to claim 1, wherein the safety node is located at a stab plate of the hydrocarbon extraction system.

7. A method of controlling a valve in a hydrocarbon extraction facility comprising the steps of:
providing a control system for the hydrocarbon extraction facility, the control system comprising a subsea control module associated with a first housing comprising a hydraulic input, a hydraulic output, and a control device for controlling flow between the hydraulic input and the hydraulic output, wherein the hydraulic input is coupled to a hydraulic supply line;
providing a safety node associated with a separate second housing, said safety node comprising a safety node hydraulic input coupled to the subsea control module hydraulic output, a safety node hydraulic output coupled to a hydraulically operated device, a directional control valve disposed between the safety node hydraulic input and the safety node hydraulic output, a power supply, a functional safety electronics module comprising a logic solver in operable communication with the directional control valve, a first wet mate connector electrically coupled to the power supply to allow external power to be supplied to the power supply, and a second wet mate connector electrically coupled to an interface for the logic solver and communicably coupling the logic solver to one or more sensors wherein the logic solver receives data from the one or more sensors, and determines whether a given condition is present based at least in part on the data; wherein the subsea control module is arranged upstream of a stab plate associated with the safety node such that the hydraulic supply line passes through the subsea control module before terminating at a production master valve, and electric power is routed through the subsea control module to the safety node;
operating the directional control valve to permit hydraulic communication between the safety node hydraulic input and the safety node hydraulic output in response to the presence of the given condition and inhibit hydraulic communication between the safety node hydraulic input and the safety node hydraulic output in response to the absence of the given condition; and
supplying hydraulic pressure to the hydraulically operated device when the directional control valve is operated to permit hydraulic communication between the safety node hydraulic input and the safety node hydraulic output.

8. A method of retrofitting a control system for an underwater hydrocarbon extraction facility with a safety node, comprising:
disconnecting a hydraulic output of a subsea control module associated with a first housing from a directional control valve;
connecting the hydraulic output of subsea control module to a hydraulic input form in a separate second housing of the safety node; and
connecting a hydraulic output of the safety node to the directional control valve, wherein the safety node includes:
a power supply;
a functional safety electronics module comprising a logic solver in operable communication with the directional control valve, wherein the logic solver is configured to operate the directional control valve to permit hydraulic communication between the hydraulic input and the hydraulic output of the safety node in response to the presence of a given condition and inhibit hydraulic communication between the hydraulic input and the hydraulic output of the safety node in response to the absence of the given condition;

a first wet mate connector electrically coupled to the power supply to allow external power to be supplied to the power supply; and a second wet mate connector electrically coupled to an interface for the logic solver and communicably coupling the logic solver to a sensor, wherein the logic solver receives data from the one or more sensors, and determines whether the given condition is present based at least in part on the data;

wherein the subsea control module is arranged upstream of a stab plate associated with the safety node such that a hydraulic supply line passes through the subsea control module before terminating at a production master valve, and electric power is routed through the subsea control module to the safety node.

9. The method according to claim 8, wherein the step of disconnecting is performed at a stab plate of the underwater hydrocarbon extraction facility.

10. The method according to claim 8, wherein the method further comprises the step of:

connecting an electrical power supply to the functional safety electronics module of the safety node.

11. The method according to claim 8, wherein the method further comprises the step of:

connecting an external sensor to the safety node, said external sensor monitoring the given condition.

12. The method according to claim 8, wherein the given condition is a range of temperatures.

13. The method according to claim 8, wherein the given condition is a range of pressures.

* * * * *